United States Patent [19]

Bevan

[11] 4,094,445

[45] June 13, 1978

[54] HIGH SPEED BEER DISPENSING METHOD

[75] Inventor: James Bevan, Hatboro, Pa.

[73] Assignee: Elliott-Lewis Corporation, Philadelphia, Pa.

[21] Appl. No.: 346,186

[22] Filed: Mar. 29, 1973

[51] Int. Cl.[2] ..... B67D 1/04; B65D 83/14

[52] U.S. Cl. ..... 222/1; 141/11; 222/146 C

[58] Field of Search ..... 222/1, 146 C, 394; 141/11, 82

[56] References Cited

U.S. PATENT DOCUMENTS

| | | | |
|---|---|---|---|
| 2,016,384 | 10/1935 | Meyer | 141/11 X |
| 2,752,083 | 6/1956 | Ullman et al. | 141/11 X |
| 2,763,994 | 9/1956 | Chandler | 222/1 UX |
| 3,057,517 | 10/1962 | Douglas | 222/1 |
| 4,011,896 | 3/1977 | Nilson et al. | 222/146 C |

FOREIGN PATENT DOCUMENTS

| | | | |
|---|---|---|---|
| 910,565 | 11/1962 | United Kingdom | 141/11 |

OTHER PUBLICATIONS

United States Brewer's Foundation; *A Beer Dispensing Handbook*: N.Y. New York, 1952.

*Primary Examiner*—Robert B. Reeves
*Assistant Examiner*—David A. Scherbel
*Attorney, Agent, or Firm*—Howson & Howson

[57] ABSTRACT

A method is provided for dispensing beer rapidly into a series of containers for mass distribution to consumers at public gatherings such as stadiums, race tracks, etc. The beer is contained in kegs and is supplied to a multi-tap dispenser through a refrigerated supply line. A coolant is circulated around the beer in the supply line and in the dispenser for cooling the beer. The temperature of the beer is maintained sufficiently close to its freezing temperature as to permit pouring from the taps while preventing excessive foam from being generated in the containers as the beer is poured. Preferably, the beer is maintained at less than 34° F and preferably within about ½°-2° F of its freezing temperature which is approximately 28° F for most beer. The pressure drop in the beer supply line is also controlled in order to avoid excessive agitation of the beer.

2 Claims, 3 Drawing Figures

REFRIGERATING UNIT
COOLANT RESERVOIR
BEER
BEER
COMP. AIR

HIGH SPEED BEER DISPENSING METHOD

The present invention relates to beverage dispensing systems, and more particularly, the present invention relates to a method for dispensing beer relatively rapidly from a tap to expedite mass distribution of the beer to consumers.

At present, it is customary for beverages such as beer and soda to be available for purchase by spectators at large public gatherings such as sports events. Heretofore, these beverages have been sold in closed containers such as can or bottles; however, distribution of beverages in this manner is undesirable because the vendor must carry the additional weight of the containers and because the discarded empty containers present a safety hazard to the spectators. The safety hazard is ameliorated when the vendor pours the beverage directly into a plastic or paper cup for the spectator and retains the empty container; however, this procedure has the obvious disadvantage of impairing the distribution efficiency of the vendor because it is relatively slow. A further disadvantage of this procedure lies in the fact that the pre-cooled beer tends to warm-up while being carried by the vendor, and in addition to becoming too warm to drink, the foaming tendency of warm beer makes it difficult to pour quickly.

Vendors have been able to eliminate some of the aforementioned disadvantages by selling draft beer in paper or plastic cups which are filled from taps at a central location and carried to the customers on trays. Although this method of distribution is somewhat more efficient that that mentioned above, the critical path in the distribution process is the speed with which the beer may be poured from the taps. For instance, it is known that rapid pouring of beer tends to create a head on the beer. If the head is too large, the customers are likely to be dissatisfied; on the other hand, if the cup is filled with beer, the head overflows the cup and is wasted. Although the formation of a head may be minimized by causing the beer to run down the inside of the cup during pouring, such procedure has the disadvantage of requiring the vendor to handle each cup individually, thereby preventing the beer from being poured rapidly and distributed expeditiously.

It is customary for beer to be chilled before it is served. In installations where the beer is contained in kegs and is supplied to taps located at a distance, it is not uncommon for the line through which the beer flows to the taps to be cooled to ensure delivery of the beer at the proper temperture for drinking. Normally, beer is dispensed from a tap at a temperature ranging between 38°–44° F. Examples of various types of apparatus which have been provided for cooling and dispensing beer are disclosed in the following U.S. Patents: Nos. 2,342,299; 2,162,649; 2,294,119; 2,678,549; 3,215,312; 2,153,355; and 2,646,667. Although each of the aforementioned patented dispensing systems may operate satisfactorily, none is capable of dispensing beer sufficiently rapidly as to enable it to be used effectively by vendors to distribute beer efficiently and with a minimum of waste to a large number of people.

With the foregoing in mind, it is a primary object of the present invention to provide a novel method for dispensing beer rapidly into containers for mass distribution to consumers.

It is another object of the present invention to provide a method by which beer may be poured into containers with a minimum of waste.

As another object, the present invention provides an improved method for pouring beer into containers in such a manner as to control the foaming of the beer so that the containers may be filled accurately to predetermined levels with beer.

It is a still further object of the present invention to provide a unique method by which beer may be dispensed relatively rapidly even by untrained persons.

As a still further object, the present invention provides a new method for dispensing draft beer in a manner which ensures a uniform and pleasing appearance of the beer as well as a comfortable drinking temperature when the beer is delivered to the customer.

More specifically, the present invention provides a high-speed beer-dispensing system which is particularly suited for use in distributing beer in containers to spectators at large public gatherings such as sports events, race tracks, or the like. In the system, beer is contained under pressure in kegs, and the beer is supplied to a multi-tap dispenser by a refrigerated line. A coolant is circulated around the beer in the line and through the dispenser before being returned to a refrigerating unit. The coolant meaintains the temperature of th beer below 34° F. and preferably within ½°–2° F. of its freezing point which, for most beer, is 28° F. The cooling capacity of the refrigerating unit is oversized to maintain the temperaure of the beer within the above-noted temperature range regardless of the rate at which beer is being poured from the dispenser. In order to minimize agitation of the beer, the system is designed so that the pressure at the dispenser is substantilly the same as the pressure in the kegs. The pressure drop between the kegs and the dispenser should be less than 10 psi, and preferably less than 2 psi. When the temperature of the beer is maintained within the above-noted range during pouring, the beer does not foam sufficiently as to have a pleasing appearance. However, in order to produce a controlled amount of foam, the beer is flowed through an adjustable valve located upstream of each tap on the dispenser, and the valve is pre-adjusted to produce a pressure drop as the beer flows for creating the foam.

These and other objects, features and advantages of the present invention should become apparent from the following description when taken in conjunction with the accompanying drawing in which.

Figures 1, 2, 3:
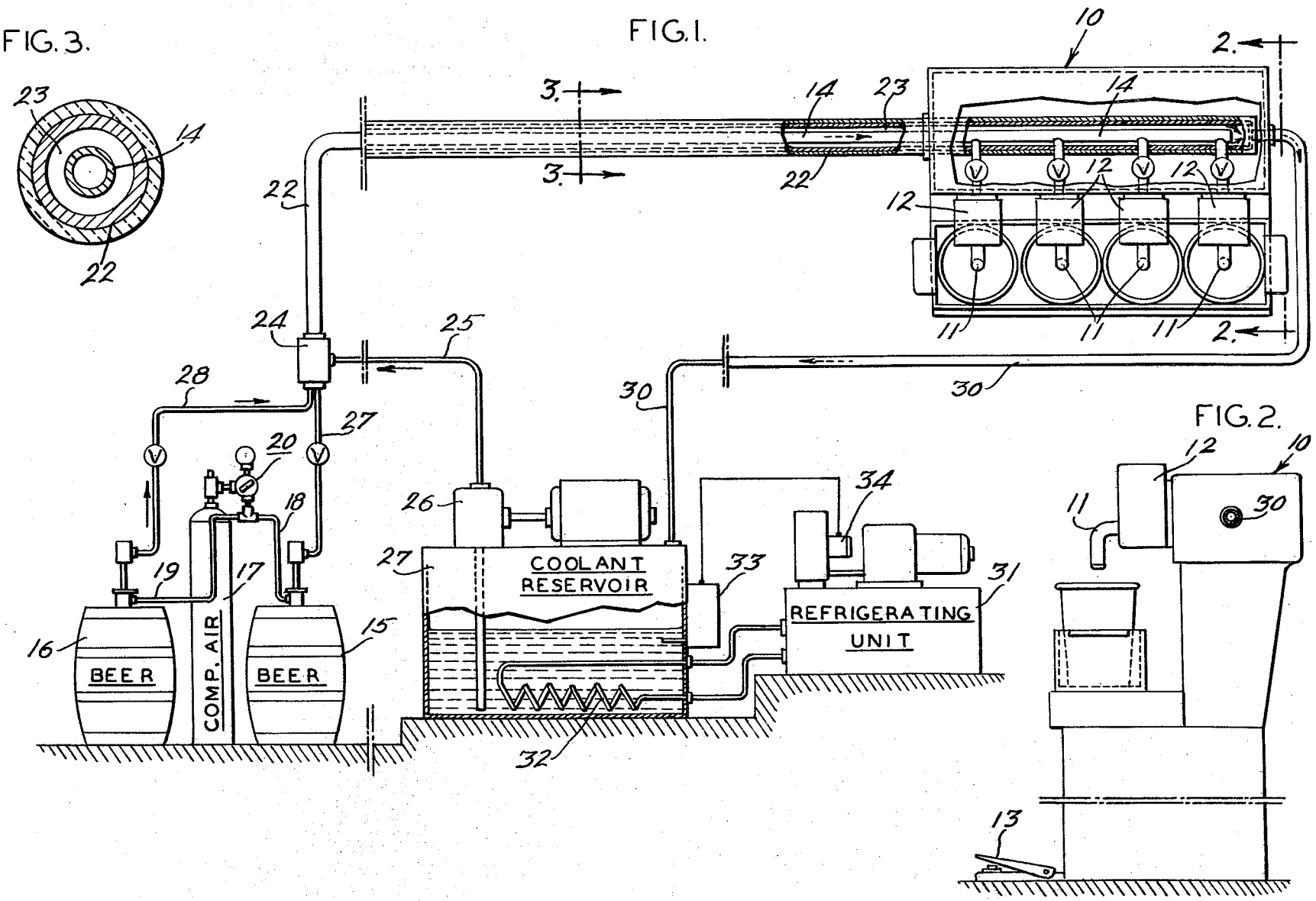
FIG. 1 is a schematic diagram of a high-speed beer-dispensing system which may be utilized in practicing the method of the present invention.
FIG. 2 is an elevational view taken along line 2—2 of FIG. 1 to illustrate a multi-tap beer dispenser.
FIG. 3 is a sectional view taken along line 3—3 of FIG. 1.

Referring now to the drawing, there is illustrated schematically in FIG. 1 a beer-dispensing system which is particularly suited for use in practicing the method of the present invention. The system includes a multi-tap dispenser 10 which has a series of horizontally-spaced pouring spouts 11,11 which, in the present instance, are four in number. As best seen in FIG. 2, the flow of beer through the pouring spouts 11,11 is controlled by means of a like series of solenoid valves 12,12 which are electrically connected to a common foot switch 13. The solenoid valves 12,12 are connected inside the dispenser 10 to a supply line 14, and the supply line 14 is connected to kegs of beer 15 and 16 stored at a location remote from the dispenser 10. The kegs 15 and 16 are pressurized by a compressed gas such as air contained in a pressure tank 17 or supplied by a compressor. The tank 17 is connected by pressure lines 18 and 19 to the kegs 15 and 16, respectively, and the pressure in the kegs 15 and 16 is regulated by a valve and regulator assembly 20 connected to the top of the pressure tank 17. Thus, when the foot switch 13 is depressed, the pressure in the kegs 15 and 16 causes the beer to flow through the supply line 14 to the dispenser 10 and out of the pouring spouts 11,11.

In order to cool the beer before it is dispensed from the pouring spouts 11,11, the beer supply line 14 is refrigerated. To this end, an insulated jacket 22 surrounds the supply line 14 and forms an annular flow passage 23 around the outside of the line 14, and a coolant is flowed through the annular passage 23 along the outside of the supply line 14 for cooling the beer flowing therein. The coolant is introduced into the passage 23 by a junction 24 which is conncted through a pipe 25 to a circulating pump 26 on a coolant reservoir 27. The junction 24 also is connected to valved beer supply lines 27 and 28 which are connected to the kegs 15 and 16, respectively. In order to simplify the schematic diagram, the junction 24 is illustrated conflowing the beer from the lines 27 and 28 into the single supply line 14. It should be understood, however, that junctions and fittings, etc. are available which permit two or more jacketed beer lines to be connected to the pouring spouts of the dispenser 10 while a coolant is flowed in each jacket.

For the purpose of returning the coolant to the coolant reservoir 27 after it absorbs heat from the beer, a return line 30 is provided to interconnect the annular passage 23 and the coolant reservoir 27, and a refrigerating unit 31 having a coil 32 immersed in the coolant is provided for cooling the same. A thermostat 33 is immersed in the coolant and is connected to control means 34 on the refrigerating unit 31 for cycling the refrigerating unit in response to changes in the temperature of the coolant in the reservoir 27 for maintaining the coolant at a predetermined temperature. In the alternative, the thermostat 33 may be inserted in the beer supply line 14 adjacent the dispenser 10 for cycling the refrigerating unit 31 in response to changes in temperature of the beer rather than the coolant.

The system described thus far is generally similar to the systems which are disclosed in the aforementioned patents and which are customarily installed in taprooms for dispensing beer at a comfortable drinking temperature in a range of between 38°–44° F. In the conventional installation, a skilled bartender ordinarily adjusts the pour rate and/or position of a glass relative to the tap to ensure the formation of the desired amount of head on the beer. Although such a technique is entirely satisfactory when beer is being distributed to a relatively small number of customers, the procedure is not adequate to meet the requirements for the mass distribution of beer as required at large public gatherings.

The present invention overcomes the limitations of prior dispensing systems. To this end, it has been discovered that beer may be poured relatively rapidly into containers when the temperature of the beer is maintained close to its freezing point for controlling the foaming tendency of the beer. For instance, as the pouring temperature of the beer decreases below about 34° F. the amount of foam which is generated during pouring decreases, and when the temperature of the beer is within about ½°–2° F of its freezing temperature, an insignificant amount of foam is generated during pouring. Accordingly, as long as the temperaure of the beer is maintained slightly above its freezing temperature, it is capable of being poured rapidly into containers.

When the beer is poured at the above-noted temperature, it tends to retain its carbonization, and although the beer would not possess a flat taste, the absence of a head would give it an unsatisfactory appearance if it were served within a short time after being poured. In order to ensure the presence of at least a minimum head to provide a beer having a satisfactory appearance even when served soon after being poured, the beer is flowed through an adjustable valve which is located upstream of each pouring spout 11 and which functions to create a pressure drop so that the beer foams slightly as it flows. By adjusting the amount of the constriction placed on the flow of beer, the pressure drop, and hence the amount of form produced, may be controlled so that each container possesses precisely the same amount of beer irrespective of the speed with which it is poured.

In order to avoid excessive agitation of the beer, the system is designed so that the pressure drop in the supply line between the kegs 15 and 16 and the dispenser 10 is kept at a minimum. In other words, the pressure at the dispenser should be substantially the same as the pressure in the kegs. The pressure differential should not exceed 10 psi, and preferably should be less than 2 psi to ensure satisfactory pouring.

The coolant which is flowed around the beer supply line 14 and in the dispenser 10 is food-safe, i.e., the coolant would be harmless if taken internally. A preferred coolant is propylene glycol or glycerin, although other food-safe coolants may be used satisfactorily. Preferably, the coolants are refrigerated to a temperature which is sufficiently below the desired beer-dispensing temperature as to provide an adequate temperature differential with respect to the beer to ensure satisfactory heat transfer. It is noted that the capacities of the refrigerating unit 31 and the coolant reservoir 27 are sufficiently oversized as to maintain the dispensing temperature of the beer without regard to the speed with which it is poured. Moreover, such capacity eliminates the necessity of storing the beer in a pre-cooler.

A number of significant advantages are realized when the beer is poured at the above-noted temperature. For instance, a four spout dispensing tap 10 such as illustrated in FIGS. 1 and 2 is capable of filling 16 twelve ounce cups in one minute or about 960 cups per hour. The relatively high pouring rate is made possible because the tendency for the beer to foam during pouring is controlled. Thus it is unnecessary for the cups to be manipulated individually during pouring to prevent foaming, as would ordinarily be required if the beer were being dispensed at the usual 38°–44° F. drinking temperature. As a result, a series of the containers may be supported on a tray beneath the spouts 11,11 such as illustrated in FIGS. 1 and 2 and filled simultaneously and rapidly from the pouring spouts by relatively unskilled persons. Since the head on the beer is accurately controlled, each filled container has a uniform appearance.

In addition to providing a high-speed dispensing system, the present invention also eliminates waste. For instance, each container is preferably filled with beer and a small head to a level which is slightly below its rim, and the top of the container is covered by a plastic cap or cover. A slight space is provided between the head and the cover. It has been found that as the temperature of the beer rises during the time interval between its pouring and its delivery to the customer the head increases in size and fills the space so that when the beer is delivered to the customer, it possesses an optimum head while being at a desirable drinking temperature.

Since the temperature of the beer is about 15° below the temperature at which it is normally dispensed in taprooms, the method of the present invention would not normally be employed in situations where mass distribution of beer is not required, because it is necessary for a time interval to elapse between the pouring of the beer and its delivery to a customer in order to permit the beer to be drunk safely. For instance, if a customer were to drink the beer immediately after it is poured from the tap at the desired 28 ½°–30° F. temperature, there would be a serious risk of injury to the mouth and throat tissues of the customer because the temperature of the beer would be below 32° F and hence low enough to freeze tissues in those areas. Thus, it is highly desirable for there to be a time delay between pouring and serving in order to enable the beer to warm up to at least 32° F., and preferably to the customary drinking temperature range of between 38°–44° F.

In view of the foregoing, it should be apparent that there has now been provided an improved method for dispensing beer rapidly into containers to expedite the distribution of beer to a large number of people. The method produces poured beer having a uniform and pleasing appearance while minimizing waste.

A preferred method has been described in detail; however, various modifications, alterations and changes may be made without departing from the spirit and scope of the present invention as defined in the appended claims. Although the method has been described as particularly suited for use in dispensing beer, it should be apparent that it may be employed satisfactorily to dispense other liquids having foaming characteristics which are related to the temperature of the liquid. For instance, liquids having a foaming tendency which increases as the temperature of the liquid increases, and, vice versa, decreases as the temperature decreases may be dispensed rapidly by the method of the present invention. Examples of such liquids would be beverages such as ale, root or birch beer, champagne or the like.

I claim:

1. A method of dispensing, from a tap having a plurality of pouring spouts, a beer having a foaming tendency which is directly related to its temperature, comprising the steps of flowing the beer through a supply line to the tap, maintaining the temperatue of the beer at the lap less than 34° F and within about 2° F of its freezing temperature, disposing beneath said spouts a like number of open containers at atmospheric pressure, discharging the beer into said containers simultaneously from said spouts to a predetermined height below the top edges of the containers, covering the open end of each container after pouring, and thereafter subjecting the liquid and containers to an ambient temperature above the pouring temperature for a sufficient period of time to permit foam to form on the liquid in the containers.

2. A method according to claim 1 including the step of containing the beer under pressure at a storage location remote from the tap, flowing the beer to the tap while maintaining the pressure at the tap substantially the same as the pressure at the storage location, and causing the beer to flow through a valve in the tap upstream of each pouring spout, whereby a controlled amount of foam is generated during pouring.

* * * * *